US010228638B2

(12) United States Patent
Doshida

(10) Patent No.: US 10,228,638 B2
(45) Date of Patent: Mar. 12, 2019

(54) IMAGE FORMING APPARATUS HAVING CONCENTRATION MEASUREMENT FUNCTION

(71) Applicant: CANON KABUSHIKI KAISHA, Tokyo (JP)

(72) Inventor: Takaaki Doshida, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/882,174

(22) Filed: Jan. 29, 2018

(65) Prior Publication Data

US 2018/0253034 A1 Sep. 6, 2018

(30) Foreign Application Priority Data

Mar. 2, 2017 (JP) ..... 2017-039292

(51) Int. Cl.
*G03G 15/10* (2006.01)

(52) U.S. Cl.
CPC ..... *G03G 15/105* (2013.01)

(58) Field of Classification Search
CPC .... G03G 15/10; G03G 15/104; G03G 15/105; G03G 15/108
See application file for complete search history.

(56) References Cited

U.S. PATENT DOCUMENTS 4,008,612 A * 2/1977 Nagaoka ..... G01F 23/0007 340/619
2007/0286626 A1* 12/2007 Du ..... G03G 15/105 399/57

FOREIGN PATENT DOCUMENTS

JP H06314031 A 11/1994
JP 2009175386 A 8/2009

* cited by examiner

*Primary Examiner* — Carla J Therrien
(74) *Attorney, Agent, or Firm* — Rossi, Kimms & McDowell LLP

(57) ABSTRACT

An image forming apparatus that determines presence or absence of bubbles with a simple configuration. The image forming apparatus forms an image on a sheet using a liquid developer including toner and carrier liquid. An exposure unit exposes a photosensitive member charged by a charging unit to form an electrostatic latent image. A development unit stores the liquid developer and develops the electrostatic latent image using the liquid developer. A supplying unit supplies toner and carrier liquid to the development unit. A light receiving unit receives light that is emitted from a light emitting unit and passes through the liquid developer in the development unit, and to output an output value based on a light receiving amount. A controller determines whether a bubble is generating in the liquid developer according to a period after the output value exceeding the first threshold until falling below a second threshold.

7 Claims, 8 Drawing Sheets

IMAGE FORMING APPARATUS HAVING CONCENTRATION MEASUREMENT FUNCTION

BACKGROUND OF THE INVENTION

Field of the Invention

The present invention relates to a technique for measuring concentration of a target substance in liquid, for example, concentration of toner in liquid developer.

Description of the Related Art

There is a conventional concentration measurement device for measuring concentration of a target substance in liquid. For example, an electrophotographic apparatus is provided with a concentration measurement device that measures toner concentration in liquid developer including toner particles and carrier liquid for distributing the toner particles. A liquid development device in an electrophotographic apparatus develops an electrostatic latent image formed on an image bearing member using liquid developer. Value of liquid developer is being revised in recent years because of an advantage that is unrealizable with dry powders developer. Since an electrophotographic apparatus uses extremely minute toner of submicron size, high definition is achieved and texture of a printing press level is obtained. Moreover, since toner in liquid developer is fixed to a paper sheet at a relatively low temperature, power consumption is saved.

Such a liquid development device may develop an image after pumping up liquid developer from a liquid-developer tank once in order to prevent carrier liquid from adhering excessively to a surface of an image bearing member. For example, a part of a developing roller is immersed in the liquid developer in the liquid-developer tank, and the image is developed by bringing the liquid developer adhered by rotating the developing roller into contact with the image bearing member. Such a development device is needed to control a toner concentration in carrier liquid within a predetermined range in order to maintain image density on a paper sheet uniformly and to maintain high definition. This needs control that measures the toner concentration in the liquid developer accurately and keeps the concentration constant.

For example, there is a proposed concentration measurement device that detects and measures toner concentration on the basis of an optical transmittance of liquid developer after giving external pressure to a part of pipe through which the liquid developer is sent to thin thickness of the part (Japanese Laid-Open Patent Publication (Kokai) No. 2009-175386 (JP 2009-175386A)). Since the device measures the toner concentration in a state where the liquid developer flows, precipitation of the toner is prevented, which achieves the concentration measurement at a high accuracy. However, bubbles may generate in the liquid developer sent to the concentration measurement device due to various factors, such as mixing from a gap of a coupling of a pipe. The bubbles may change the optical transmittance and cause a measurement error.

Japanese Laid-Open Patent Publication (Kokai) No. H6-314031 (JP H6-314031A) proposes a configuration that branches a pipe that sends liquid into a measurement path and a bypassing path arranged above the measurement path. A toner concentration measurement device is arranged in the measurement path. Most of bubbles flow through the bypassing path due to buoyant force. Accordingly, the configuration prevents degradation of measurement accuracy of the toner concentration due to bubbles.

The configuration of JP H6-314031A reduces mixing of bubbles to the liquid developer but cannot detect presence or absence of bubbles. As mentioned above, the measurement error becomes large in a case where the toner concentration of the liquid developer is measured in a state where bubbles are mixed. Moreover, when an image is formed by the liquid developer in which the bubbles are mixed, a liquid-layer unformed line may occur on a developing roller. In that case, an image defect may occur because a toner untransferred region may occur in an image that is finally formed on a paper sheet through the following image forming process. It should be noted that installation of an exclusive configuration for determining the presence or absence of bubbles raises a cost.

SUMMARY OF THE INVENTION

The present invention provides an image forming apparatus that determines presence or absence of bubbles with a simple configuration.

Accordingly, an aspect of the present invention provides an image forming apparatus that forms an image on a sheet using a liquid developer including toner and carrier liquid. The image forming apparatus includes a photosensitive member, a charging unit configured to charge the photosensitive member, an exposure unit configured to expose the photosensitive member charged to form an electrostatic latent image, a development unit configured to store the liquid developer and to develop the electrostatic latent image using the liquid developer; a supplying unit configured to supply toner and carrier liquid to the development unit, a light emitting unit, a light receiving unit configured to receive light that is emitted from the light emitting unit and passes through the liquid developer in the development unit, and to output an output value based on a light receiving amount, and a controller configured to determine whether a bubble is generating in the liquid developer according to a period after the output value output from the light receiving unit exceeding the first threshold until falling below a second threshold.

According to the present invention, the image forming apparatus that determines the presence or absence of bubbles with the simple configuration is provided.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

Figure 1:
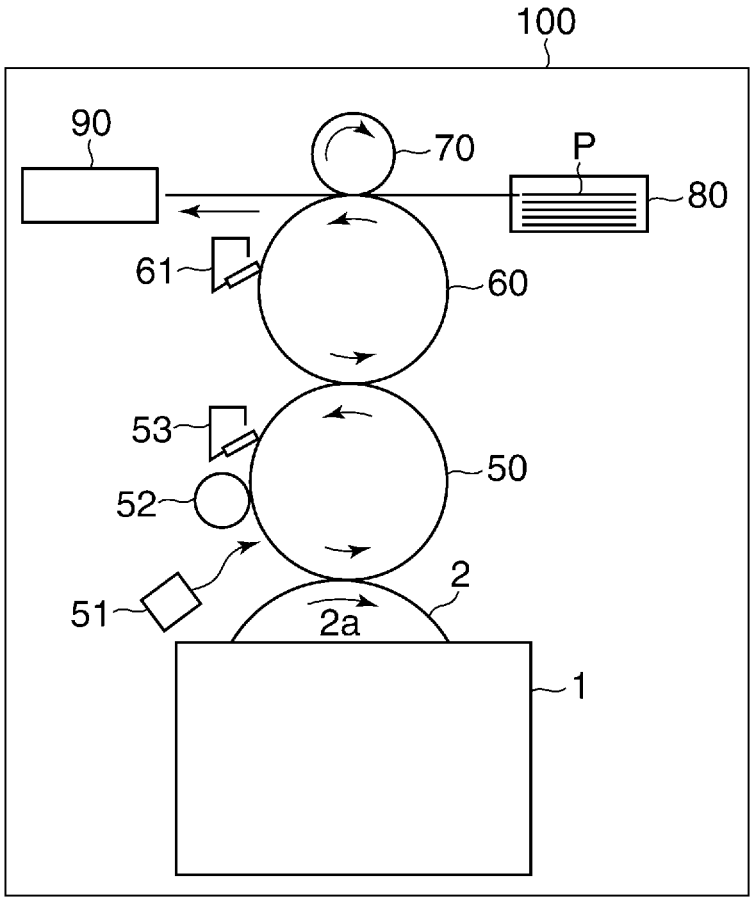
FIG. 1 is a schematic sectional view showing an image forming apparatus according to a first embodiment of the present invention.

FIG. 1 is a schematic sectional view showing an image forming apparatus according to a first embodiment of the present invention. The image forming apparatus 100 is an apparatus of the wet electrophotographic system that uses liquid developer, and is provided with a development device 1 as a liquid development device. The image forming apparatus 100 has one image forming station. A configuration that forms a multicolor image may be employed by arranging a plurality of image forming apparatuses 100. The development device 1 is filled up with predetermined quantity of the liquid developer. The liquid developer used by the development device 1 includes toner and carrier liquid. In the liquid developer, toner particles charged in minus by a function of charge control agent and plus ions are included in the carrier liquid that consists of insulating Isopar (TM). The toner in liquid is a particle with a mean particle size of about 1 μm.

The image forming apparatus 100 has a photosensitive drum (photosensitive member) 50, an intermediate transfer drum 60, and a transfer roller 70, as main components of the image forming unit that forms an image developed by the development device 1 onto a sheet. The development device 1 has a developing roller 2 that rotates in a clockwise direction shown by an arrow 2*a* in FIG. 1. The photosensitive drum 50 contacts the development device 1 and rotates in a counterclockwise direction in FIG. 1 when an image is formed. The photosensitive drum 50 is charged by a charging member (charging unit) 52 to which bias power is supplied from a high voltage power supply (not shown). Although a charging roller is employed as the charging member 52, a non-contact member like a corona electrostatic charger may be employed. An exposure device 51 forms an electrostatic latent image on a surface of the photosensitive drum 50 charged. The exposure device 51 scans a laser beam emitted from a light source by rotating a polygon mirror, deflects the scanning light beam with a plurality of mirrors, and exposes the photosensitive drum 50 by converging the light beam onto a bus thereof with an fθ lens. Thereby, an electrostatic latent image corresponding to an image signal is formed on the photosensitive drum 50 (on an image bearing member). Potential difference between the high voltage bias applied to the developing roller 2 and the surface potential of the photosensitive drum 50 develops the electrostatic latent image on the photosensitive drum 50 with the liquid developer and forms a toner image.

The intermediate transfer drum 60 rotates in the clockwise direction in FIG. 1 Potential difference between the bias of the intermediate transfer drum 60 applied by the high voltage power supply and the surface potential of the photosensitive drum 50 primary transfers the toner image formed on the photosensitive drum 50 to the intermediate transfer drum 60. Residual toner that remains on the photosensitive drum 50 is removed by a cleaning device 53. The toner image transferred on the intermediate transfer drum 60 is secondarily transferred to a sheet P in an area where the intermediate transfer drum 60 is in pressure contact with the transfer roller 70 across the sheet. That is, the toner image is transferred to the sheet P conveyed from a sheet cassette 80 by the potential difference between the transfer roller 70 to which the bias power is supplied from the high voltage power supply and the intermediate transfer drum 60. A fixing unit 90 applies a predetermined fixing process to the sheet P to which the toner image is transferred, and then, the sheet is ejected outside the apparatus as a recorded image. Moreover, a cleaning device 61 cleans fogging toner and secondary-transfer residual toner that adhere to the surface of the intermediate transfer drum 60 at a downstream position of the secondary transfer position to the sheet P in a rotational direction of the intermediate transfer drum 60. It should be noted that an intermediate transfer belt may be employed instead of the intermediate transfer drum 60 as the member that transfers the toner image formed on the photosensitive drum 50 to the sheet P. The intermediate transfer belt is particularly effective in a case where a multicolor image is formed.

Incidentally, the photosensitive drum 50 is an image bearing member that is configured by forming an amorphous silicon photosensitive layer on a rigid base made from aluminum and preferably by forming a protective layer made from silicone resin thereover. The photosensitive drum 50 is charged negatively. The surface potential of the photosensitive drum 50 after being charged by the charging member 52 is −600 [V]. The surface potential of the photosensitive drum 50 after being exposed by the exposure device 51 is 200 [V]. The photosensitive drum 50 of which outer diameter is 100 mm is rotated by a motor (not shown) at a process speed (circumferential speed) of 300 mm/sec around a center axis. Thereby, the image forming apparatus 100 conveys 50 sheets of A4 sheets in 1 minute. It should be noted an aluminum-made inner cylinder of the photosensitive drum 50 is grounded. Moreover, a bias is also applied to the intermediate transfer drum 60. The transfer bias in the primary transfer is 300 [V] and that in the secondary transfer is 1500 [V], for example.

Figure 2:
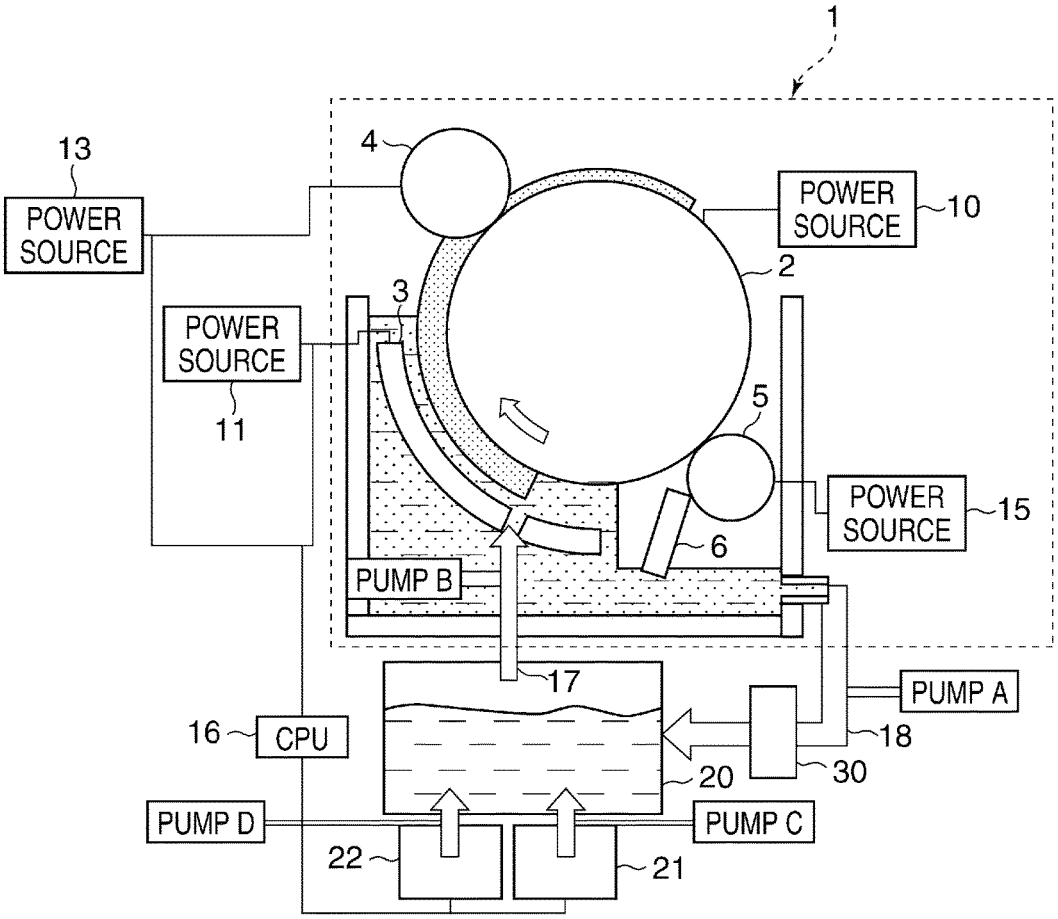
FIG. 2 is a schematic view showing a development device shown in FIG. 1 and its circumference configuration.

FIG. 2 is a schematic view showing the development device 1 and its circumference configuration. The concentration measurement device of the first embodiment includes a CPU 16 and a thin tube 18 in addition to a measurement unit 30 that is a developer concentration sensor. A liquid tank 20 that is a container is connected to the development device 1 through two paths including a path 17 and the thin tube 18. A supplying device 21 and a liquid supplying device 22 are connected to the liquid tank 20. The CPU 16 controls the entire development device 1 and pumps A, B, C, and D. An electrode 3 faces the developing roller 2 across a gap of about 1 mm. A roller 4 and cleaning roller 5 face the developing roller 2. A power source 10 is connected to the developing roller 2, and a power source 11 is connected to the electrode 3. A power source 15 is connected to the cleaning roller 5, and a power source 13 is connected to the roller 4.

When an image is formed, the liquid developer stored in the liquid tank 20 is supplied to the development device 1 through the path 17 by the pump B. The liquid developer in the development device 1 is returned to the liquid tank 20 through the thin tube 18 by the pump A. Thereby, the liquid developer circulates between the liquid tank 20 and the development device 1. Moreover, the pump C supplies high-concentration liquid developer to the liquid tank 20 from the supplying device 21, and the pump D supplies liquid to the liquid tank 20 from the liquid supplying device 22.

In the image forming operation, the liquid developer supplied to the upper development device 1 from the liquid tank 20 flows into a gap between the developing roller 2 and the electrode 3. The power source 10 applies a bias of −400 [V] to the developing roller 2, and the power source 11 applies a bias of −600 [V]to the electrode 3. Thereby, the toner of negative polarity is pushed toward the developing roller 2 together with the surrounding carrier liquid. An outer diameter of the developing roller 2 shall be 50 mm, and an angle of the section that faces the electrode 3 shall be 70 degrees viewed from the developing roller 2.

After that, the liquid developer reaches the roller 4 according to the rotation of the developing roller 2. The power source 13 applies a bias so that the surface of the roller 4 generates the potential difference of −400 [V] to the developing roller 2. Accordingly, when the liquid developer passes between the developing roller 2 and the roller 4, the toner in the liquid developer is further pushed toward the developing roller 2, and a high-concentration liquid-developer layer of uniform thickness is formed on the surface of the developing roller 2. On the other hand, the surplus carrier liquid stripped from the toner by the roller 4 is abolished toward the electrode 3 according to the rotation. An outside diameter of the roller 4 shall be 15 mm. Moreover, a roughness Rz (the maximum height) of surface of the roller 4 is equal to or less than 0.1 μm, for example, so as to adsorb the carrier moderately and to send a flat toner layer to a developing section (a contact section with the photosensitive drum 50).

After that, the electrostatic latent image formed on the photosensitive drum 50 is developed by the developing roller 2. A part of the liquid developer that was not used by the development of the photosensitive drum 50 reaches the cleaning roller 5 soon. The power source 15 applies a bias so that the surface of the cleaning roller 5 generates the potential difference of +200 [V] to the developing roller 2. Thereby, the toner particles with the negative polarity on the developing roller 2 are electrically drawn toward the cleaning roller 5 and are collected. Moreover, the toner particles adhering to the cleaning roller 5 are collected by a blade 6 of which electric potential is the same as that of the cleaning roller 5, and then flow into the liquid developer that flows through the inside of the development device 1 again.

Next, circulation and supply of the liquid developer, and concentration detection (measurement) of the toner in the liquid developer will be described. The measurement unit 30 is installed in the thin tube 18. The target concentration range (weight ratio range) of the toner in the liquid developer contained in the liquid tank 20 is 2% through 4%. The measurement unit 30 optically measures the toner concentration (concentration of a target substance in liquid) in the liquid developer sent to the liquid tank 20 from the development device 1 through the thin tube 18 by the pump A. The CPU 16 maintains the toner concentration within a desired range on the basis of the measurement result of the toner concentration. That is, the CPU 16 controls an action for supplying the high-concentration liquid developer to the liquid tank 20 from the supplying device 21 by the pump C, and an action for supplying the carrier liquid to the liquid tank 20 from the liquid supplying device 22 by the pump D.

Figure 3:
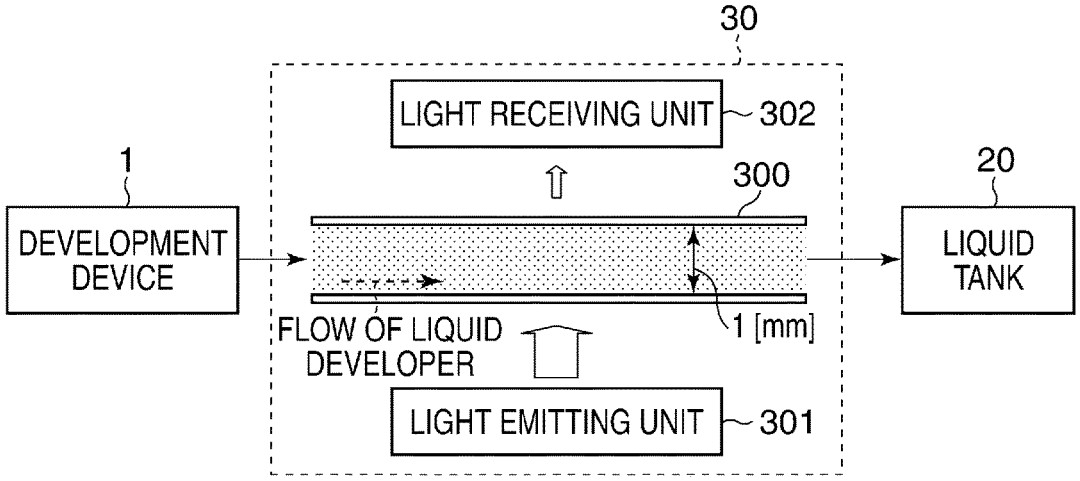
FIG. 3 is a schematic view showing a configuration of a measurement unit shown in FIG. 2.

A measuring method of the toner concentration in the liquid developer in the measurement unit 30 will be described with reference to FIG. 3 through FIG. 9. FIG. 3 is a schematic view showing a configuration of the measurement unit 30. The measurement unit 30 detects an optical transmittance of the liquid developer in order to detect and measure the toner concentration in the liquid developer. The measurement unit 30 is constituted by a cell 300 that is a transparent pipe with optical transparency, and a light emitting unit 301 and light receiving unit 302. The sections are arranged at positions facing each other while sandwiching the cell 300. An air clearance (GAP length) of the cell 300 in a light irradiation direction shall be 1 mm. This is because a long optical path length that passes liquid makes it difficult to measure due to reduction of a transmitting light amount in a case where liquid developer including black toner of which optical transmittance is extremely low is measured. It should be noted that the cell 300 is made from resin material. The pump A sends the liquid developer from the development device 1 to the cell 300.

Figure 4:
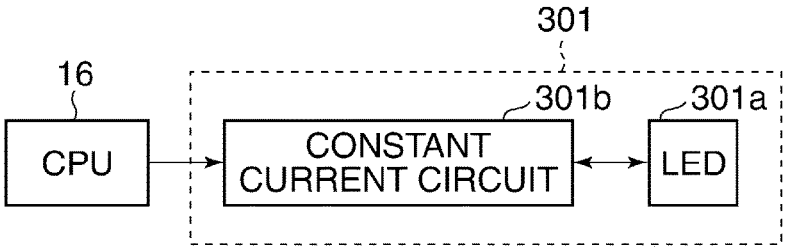
FIG. 4 is a block diagram showing a configuration of a light emitting unit shown in FIG. 3.
Figure 5:
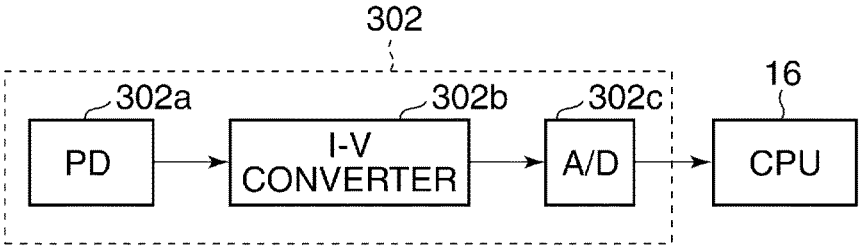
FIG. 5 is a block diagram showing a configuration of a light receiving unit shown in FIG. 3.

FIG. 4 is a block diagram showing a configuration of the light emitting unit 301. FIG. 5 is a block diagram showing a configuration of the light receiving unit 302. As shown in FIG. 4, the light emitting unit 301 has an LED 301*a* that is a light emitting element, and a constant current circuit 301*b* that controls electric current supplied to the LED 301*a* so as to become constant. ON/OFF of the electric current supplied to the LED 301*a* and a setting about a target current value are controlled by signals from the CPU 16. When the CPU 16 starts emission control, the LED 301*a* irradiates the cell 300 with light, as shown in FIG. 3. An irradiation direction preferably intersects perpendicularly with a center axis of the cell 300. The light entered into the cell 300 enters into the liquid developer that fills up the cell 300 with little reduction in a transparent outer wall of the cell 300, and is absorbed in the liquid developer. Then, only the light that transmits without being absorbed outputs outside through an opposite outer wall of the cell. The output light arrives at a light receiving surface of the light receiving unit 302. The light receiving unit 302 converts a light receiving amount into a corresponding voltage value.

Figure 6:
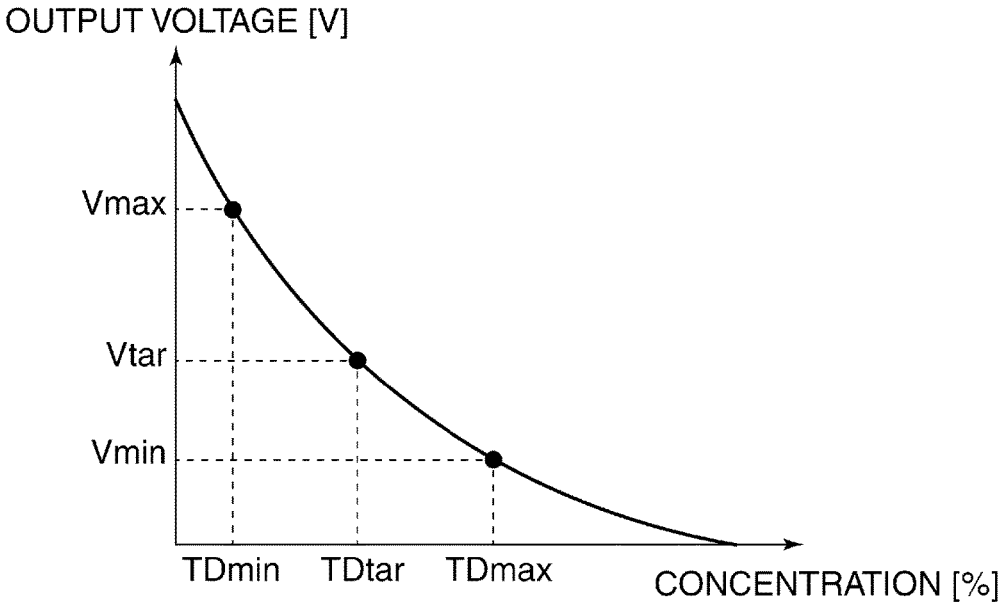
FIG. 6 is a graph showing a relationship between toner concentration of liquid developer and output voltage in the concentration measurement device according to the first embodiment.

As shown in FIG. 5, the light receiving unit 302 has a PD (photodiode) 302*a* as a light receiving element, an I-V converter 302*b* that converts the electric current that occurs in the PD 302*a* into a voltage signal, and an A/D convertor 302*c* that converts the voltage signal into a digital signal that can be recognized and processed by the CPU 16. FIG. 6 is a graph showing relation between the toner concentration (weight ratio) [%] of the liquid developer and the output voltage [V] of the I-V converter 302*b*. The output voltage varies exponentially to the toner concentration. This is because the optical transmittance of the liquid developer in which toner particles are uniformly distributed in transparent carrier has a characteristic of an exponential function to the concentration.

TDmin and TDmax respectively denote the lower limit and upper limit of a detectable concentration range of the measurement unit 30, and Vmax and Vmin denote corresponding voltages. Moreover, TDtar denotes target concentration, and Vtar denotes a corresponding output voltage. In the description, the detectable concentration range of the measurement unit 30 is determined so as to be wider than the target concentration range of 2% through 4% in the liquid tank 20. This is for computing the supplying amount of the toner or carrier required to control the toner concentration, which was once out of the target concentration range, to fall within the target concentration range with sufficient accuracy. The lower limit TDmin is 1% and the upper limit TDmax is 5% in the first embodiment. Moreover, the target concentration TDtar is 3% that is a center value of the target concentration range.

The CPU 16 controls the liquid supplying device 22 or the supplying device 21 on the basis of the comparison result of the concentration information obtained from the output voltage with the target concentration TDtar so that the toner concentration of the liquid developer in the liquid tank 20 falls within the desired concentration range.

Incidentally, a bubble may mix in the liquid tank 20, the development device 1, and the liquid circulating paths 17 and 18 therebetween. A first factor is that intense waving of a liquid surface in the liquid tank 20 due to inflow and outflow of the liquid takes air in the liquid. A second factor is that a bubble mixes in a case where the power of the image forming apparatus 100 turns ON. That is, all the liquid developer in the liquid circulating paths and the development device 1 is contained in the liquid tank 20 in a state where the power of the image forming apparatus 100 is turned OFF. Accordingly, the liquid circulating paths and the development device 1 are filled with air in the power OFF state. Immediately after turning ON the power and starting liquid circulation, the air inside the liquid circulating paths and the development device 1 is mixed in the liquid developer as bubbles. Although these bubbles gradually reduce due to buoyant force in the liquid tank 20, the state where the bubbles are mixed continues for a while. A third factor is that bubbles mix from a breakage point of the liquid circulating paths.

The bubbles mixed in the liquid developer stay in a space between the developing roller 2 and the roller 4 in the process for generating a uniform liquid layer on the developing roller 2, and generate a liquid-layer unformed line on the developing roller 2. For that reason, an image defect may occur because a toner untransferred region may occur in an image that is finally formed on a paper sheet through the following image forming process. Accordingly, the image forming process is preferably performed in a state where no bubble is in the liquid developer, which needs to provide a device that detects a bubble presence/absence state or that removes a bubble. However, installation of a new sensor or device for that purpose raises a cost.

Figure 7:
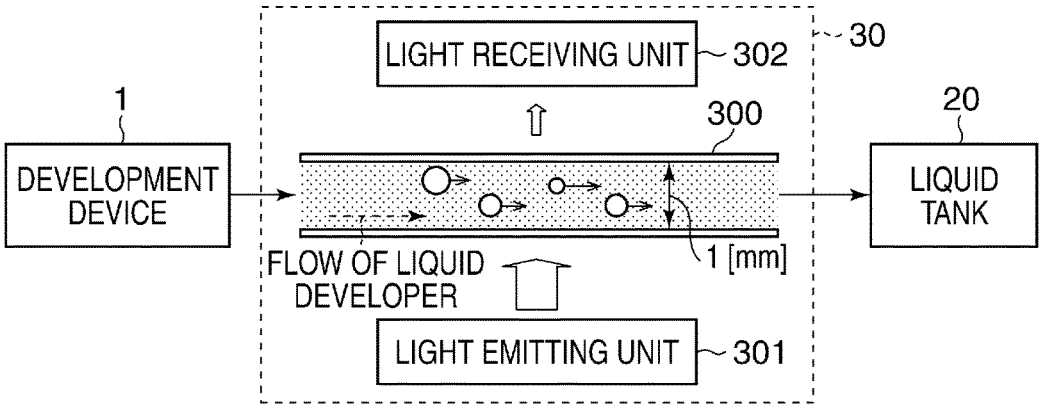
FIG. 7 is a view showing a state where the liquid developer to which bubbles are mixed flows through a cell of the measurement unit shown in FIG. 3.

In the first embodiment, the CPU 16 determines presence or absence of a bubble on the basis of the output of the existing measurement unit 30 for the purpose of the concentration measurement without newly preparing an exclusive sensor for detecting a bubble. The CPU 16 corresponds to the decision unit that decides concentration of a target substance (concentration as a measurement result) and the determination unit that determines the presence or absence of a bubble in liquid in the present invention, FIG. 7 is a view showing a state where the liquid developer to which bubbles are mixed flows through the cell 300 of the measurement unit 30. As mentioned above, the GAP length of the cell 300 is 1 mm, the diameters of many bubbles fall within a range of 0.1 mm through several millimeters. Since a bubble including no toner hardly reduces the light, the optical transmittance increases rapidly in a case where a bubble enters into a light beam zone that goes to the light receiving unit 302 from the light emitting unit 301.

Figure 8:
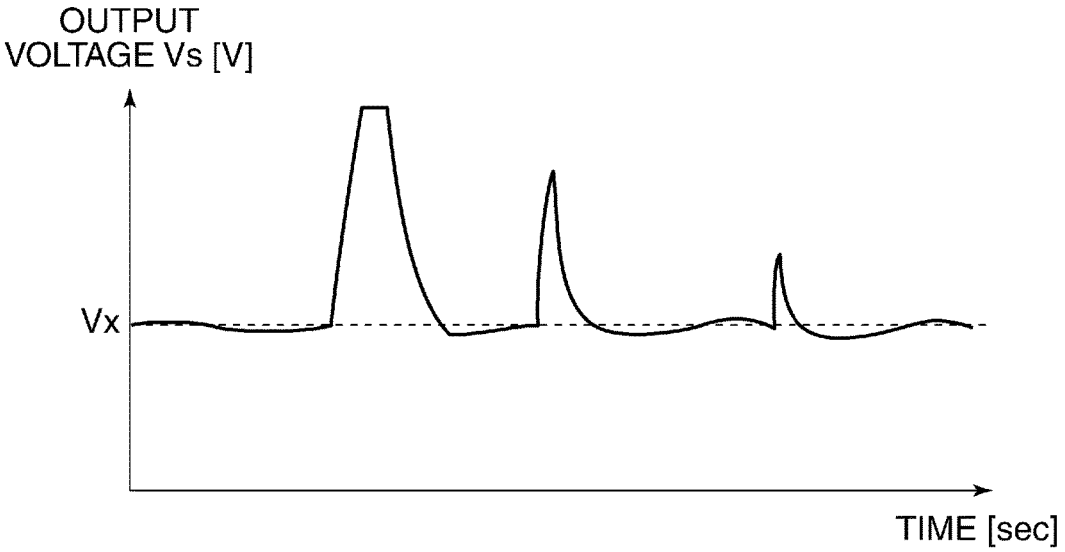
FIG. 8 is a graph showing time variation of output voltage of the measurement unit shown in FIG. 3.
Figure 9:
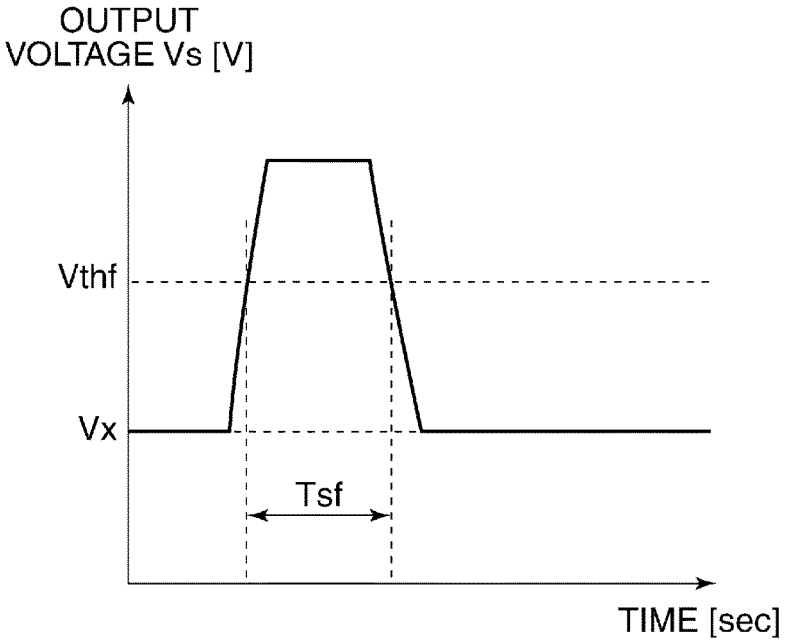
FIG. 9 is a graph showing an example of the time variation of the output voltage of the measurement unit shown in FIG. 3 in a case where a bubble passes a light beam zone of the cell.

FIG. 8 is a graph showing time variation of output voltage Vs of the measurement unit 30. FIG. 9 is a graph showing an example of the time variation of the output voltage Vs in a case where a bubble mixed into the liquid developer passes the light beam zone of the cell 300.

In the example shown in FIG. 8, the output voltage Vs shows three rapid changes (peaks) in a temporal progress. A dotted line indicates an average Vx of the output voltage Vs in a state where there is no bubble. The three peaks occur because bubbles enter into the light beam zone. The peak voltage value varies according to a bubble size and a movement speed of a bubble within the cell 300. That is, a larger bubble increases the optical transmittance and increases the output voltage Vs, Moreover, the slower the movement speed of a bubble is, the longer the period during which the output voltage Vs increases is.

The output voltage Vs rapidly changes due to presence or absence of a bubble. Accordingly, the first embodiment proposes an algorithm that determines presence or absence of a bubble using the measurement unit 30 in addition to decision of the toner concentration. The CPU 16 determines whether the output voltage Vs exceeds a predetermined first threshold Vthf, and determines that there may be a bubble when the output voltage Vs exceeds the first threshold Vthf. Then, the CPU 16 measures a period during which the output voltage Vs continuously exceeds the first threshold Vthf, i.e., measures elapsed time Tsf (period after exceeding the first threshold Vthf until falling below the first threshold Vthf, see FIG. 9), When the elapsed time Tsf falls within a predetermined time period (Tsf is longer than a first predetermined time Tmin that is the minimal time and is shorter than a second predetermined time Tmax that is the maximum time), the CPU 16 determines that there is a bubble. The first threshold Vthf, first predetermined time Tmin, and second predetermined time Tmax are beforehand stored in a storage unit like a ROM (not shown), and the CPU 16 refers to them.

The first predetermined time Tmin shall be 10 μs, for example, which is longer than elapsed time that is assumed in a case where electrostatic impulse noise occurs. It is determined that a factor of temporal rise of the output voltage Vs of 10 μs or less is noise but is not a bubble. The second predetermined time Tmax shall be 100 ms, for example, which is shorter than elapsed time that is assumed in a case where the toner concentration decreases to a predetermined concentration or lower. It is determined that a factor of continuous rise of the output voltage Vs over 100 ms is actual reduction of the toner concentration due to consumption of the toner but is not a bubble. This prevents an erroneous decision that electrostatic noise or actual concentration change is decided as the presence of a bubble.

Figure 10:
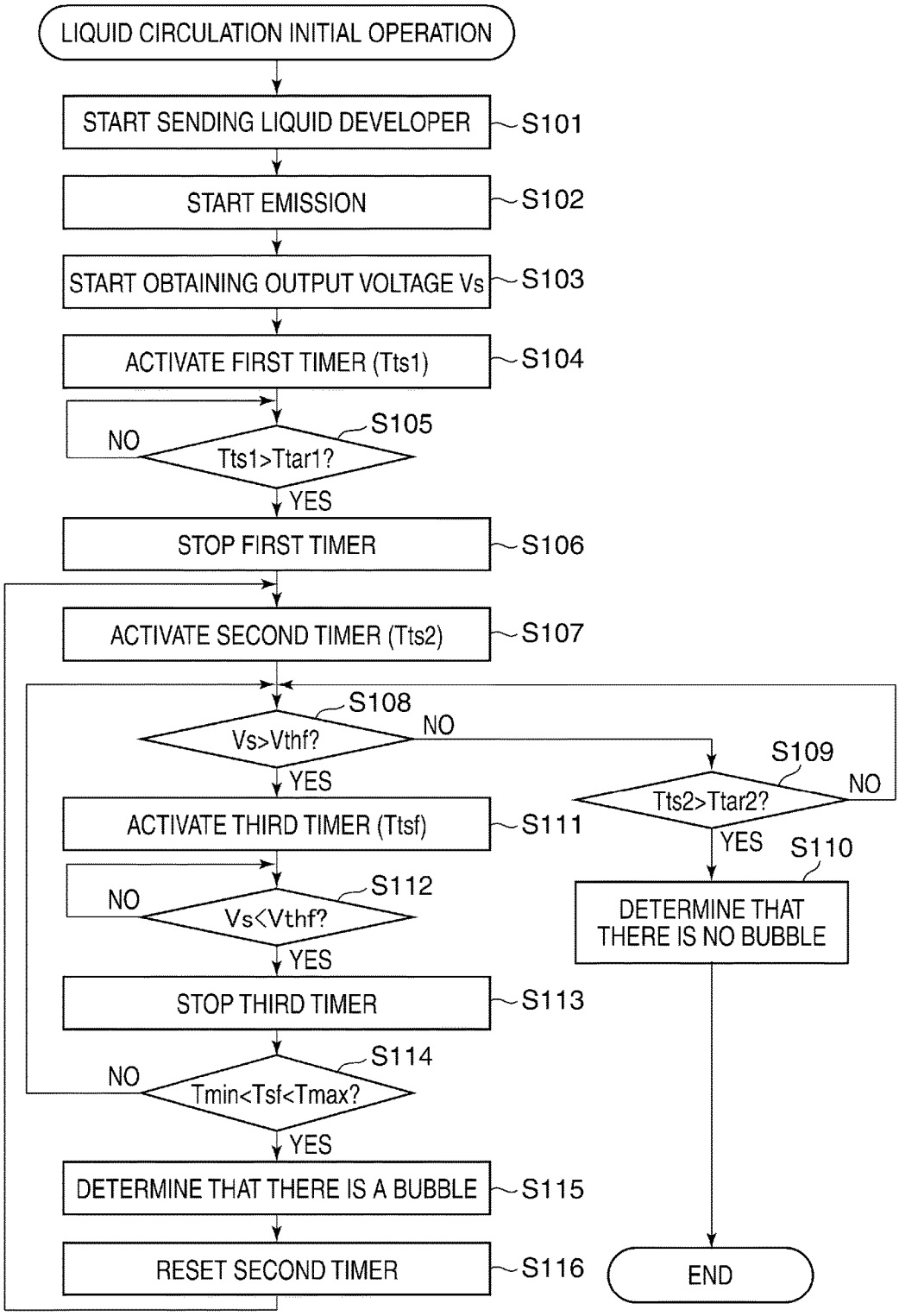
FIG. 10 is a flowchart showing a process of a liquid circulation initial operation of the concentration measurement apparatus according to the first embodiment.

FIG. 10 is a flowchart showing a process of a liquid circulation initial operation. A process in this flowchart is achieved when the CPU 16 reads and runs a program stored in a storage unit, such as a ROM, of the concentration measurement device. This process will be started immediately after the power of the image pickup apparatus 100 is turned ON. It should be noted that the process in FIG. 10 may be executed in advance of measurement of the toner concentration at any timing.

The CPU 16 starts sending the liquid developer to the development device 1 from the liquid tank 20 first (step S101). That is, the CPU 16 activates the pump A and the pump B. Thereby, the liquid developer in the liquid tank 20 flows toward the development device 1 through the path 17. Then, when the liquid developer is supplied to some extent to the development device 1, the liquid developer will flow into the liquid tank 20 through the thin tube 18 from the development device 1, and the liquid developer will circulate between the liquid tank 20 and the development device 1.

Next, the CPU 16 starts emitting the LED 301*a* of the measurement unit 30 in order to start measurement of the toner concentration (step S102), and starts obtaining the output voltage as a detection result of the light receiving unit 302 (step S103). After that, the output voltage Vs is continuously monitored. Next, the CPU 16 activates a first timer and starts counting a count value Tts1 of the first timer (step S104). Then, the CPU 16 waits until fourth predetermined time, which is equivalent to a stable period required to stir until the toner concentration becomes uniform in the liquid developer that is circulated by the pumps A and B, elapses (step S105). Specifically, the CPU 16 determines whether the count value Tts1 of the first timer exceeds a count value Ttar1 corresponding to the fourth predetermined time (Tts1>Ttar1), and determines that the fourth predetermined time elapsed in a case where the condition Tts1>Ttar1 is satisfied. The fourth predetermined time is determined beforehand on the basis of experiment results, and is stored in the ROM. The waiting for the fourth predetermined time improves the concentration determination accuracy.

When the fourth predetermined time elapsed, the CPU 16 stops the first timer (step S106), activates a second timer, and starts counting a count value Tts2 of the second timer (step S107). Then, the CPU 16 compares the output voltage Vs of the light receiving unit 302 with the predetermined first threshold Vthf, and determines whether the output voltage Vs exceeds the first threshold Vthf (Vs>Vthf, step S108). Then, when the output voltage Vs does not exceed the first threshold Vthf, the CPU 16 determines whether the count value Tts2 of the second timer exceeds the count value Ttar2 corresponding to third predetermined time (Tts2>Ttar2, step S109). The third predetermined time is beforehand set up as a period for detecting bubbles (assumed time required until generated bubbles flow into the cell 300 after starting to send the liquid), and is stored in the ROM.

When the condition Tts2>Ttar2 is not satisfied, the process returns to the step S108. When the condition Tts2>Ttar2 is satisfied (i.e., when the third predetermined time elapses while the output voltage Vs has not exceeded the first threshold Vthf), the CPU 16 proceeds with the process to step S110, determines that "there is no bubble", and finishes the process in FIG. 10. After that, the CPU 16 shifts to the measurement of the toner concentration on the basis of the output of the measurement unit 30.

As a result of the determination in the step S108, when the output voltage Vs exceeds the first threshold Vthf, the CPU 16 determines that a bubble may occur, activates a third timer, and starts measuring the elapsed time Tsf (step S111). Then, the CPU 16 determines whether the output voltage fell below the first threshold Vthf (Vs<Vthf, step S112). The CPU 16 repeats the process in the step S11 until the output voltage Vs falls below the first threshold Vthf. and stops the third timer (step S113) when the output voltage Vs falls below the first threshold Vthf. This fixes the value of the elapsed time Tsf as the period during which the output voltage Vs continuously exceeded the first threshold Vthf (see FIG. 9).

Next, the CPU 16 determines whether the elapsed time Tsf is more than the first predetermined time Tmin and is less than the second predetermined time Tmax (Tmin<Tsf<Tmax, step S114). Then, the CPU 16 returns the process to the step S108, when the condition Tmin<Tsf<Tmax is not satisfied. This is because it is determined that the output voltage Vs rose due to noise or actual toner concentration change and that no bubble occurs as mentioned above.

On the other hand, when the condition Tmin<Tsf<Tmax is satisfied, the CPU 16 determines that "there is a bubble" (step S115), resets the second timer (step S116), and returns the process to the step S107. Thereby, the count value Tts2 is newly counted and the presence or absence of a bubble is determined again. Accordingly, the liquid circulation initial operation does not finish unless it is determined that there is no bubble. In the course in which the process returning to the step S107 from the step S116 is repeated, when the output voltage Vs is continuously less than the first threshold Vthf until the third predetermined time (the count value Ttar2) elapses (NO in the step S108 and YES in the step S109), the determination of "there is a bubble" is switched to the determination of "there is no bubble" in the step S110.

When the actual toner concentration varies rapidly, it is assumed that the condition Vs<Vthf is not satisfied in the step S112 even if a long time elapsed. Accordingly, when the condition "Vs<Vthf" is not satisfied in the step S112 even if a certain time elapsed, the process in FIG. 10 may be finished. In that case, the CPU 16 may determine that the toner concentration actually becomes low. Alternatively, the process may be returned to the step S104.

It should be noted that the thresholds that are compared with the output voltage used in the steps S108 and S112 are not necessarily identical. For example, the output voltage may be compared with a second threshold that is less than the first threshold Vthf in the step S112. In this case, the elapsed time Tsf is a period until the output voltage Vs becomes less than the second threshold after exceeding the first threshold Vthf.

According to the first embodiment, the CPU 16 determines presence or absence of a bubble in the liquid developer that flows through the transparent cell 300 on the basis of the output voltage Vs of the measurement unit 30 after the output voltage Vs exceeds the first threshold Vthf. Specifically, the CPU 16 determines presence or absence of a bubble on the basis of the elapsed time Tsf until the output voltage Vs becomes lower than the first threshold Vthf after exceeding the first threshold Vthf. Thereby, the presence or absence of a bubble is determined with a simple configuration. Moreover, an exclusive sensor for determining presence or absence of a bubble is not necessary, which prevents cost rise. Furthermore, since the toner concentration is decided on the basis of the output voltage Vs after checking the state where there is no bubble, the concentration decision accuracy increases. Moreover, if the image forming process starts after determining that there is no bubble in the liquid developer, generation of an image defect resulting from a bubble can be prevented.

Moreover, since it is determined that there is a bubble in the case where the elapsed time Tsf is more than the first predetermined time Tmin and is less than the second predetermined time Tmax, erroneous decision resulting from noise or actual concentration change can be prevented.

Moreover, since the determination about presence or absence of a bubble is started when the fourth predetermined time (Ttar1) elapses after starting circulation of the liquid developer, it is determined in the state where the liquid developer is stirred uniformly, which improves the determination accuracy.

Moreover, since the CPU 16 determines presence or absence of a bubble again when it is determined that there is a bubble, the determination about presence or absence of a bubble continues until a bubble disappears.

Next, a second embodiment of the present invention will be described. In the first embodiment, the presence or absence of a bubble is determined on the basis of the elapsed time Tsf during which the output voltage Vs exceeds the first threshold Vthf continuously. In the second embodiment of the present invention, the presence or absence of a bubble is determined on the basis of a change degree of the output voltage Vs after the output voltage Vs exceeds the first threshold Vthf. The second embodiment will be described with reference to FIG. 11A, FIG. 11B and FIG. 12 in addition to the description of the first embodiment.

Figure 11A:
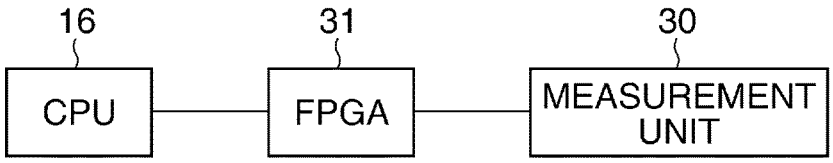
FIG. 11A is a block diagram schematically showing a configuration of a main part of a concentration measurement device according to a second embodiment of the present invention.

FIG. 11A is a block diagram schematically showing a main part of a concentration measurement device according to the second embodiment of the present invention. An FPGA (a field-programmable gate array) 31, which is a signal processing unit that applies an arithmetic process to the output of the measurement unit 30, is added to a position between the CPU 16 and the measurement unit 30 in FIG. 2. The FPGA 31 controls emission of the light emitting unit 301 of the measurement unit 30 and applies a signal process to the output of the light receiving unit 302 according to instructions from the CPU 16. Configuration other than the FPGA 31 is the same as that of the first embodiment.

Figure 11B:
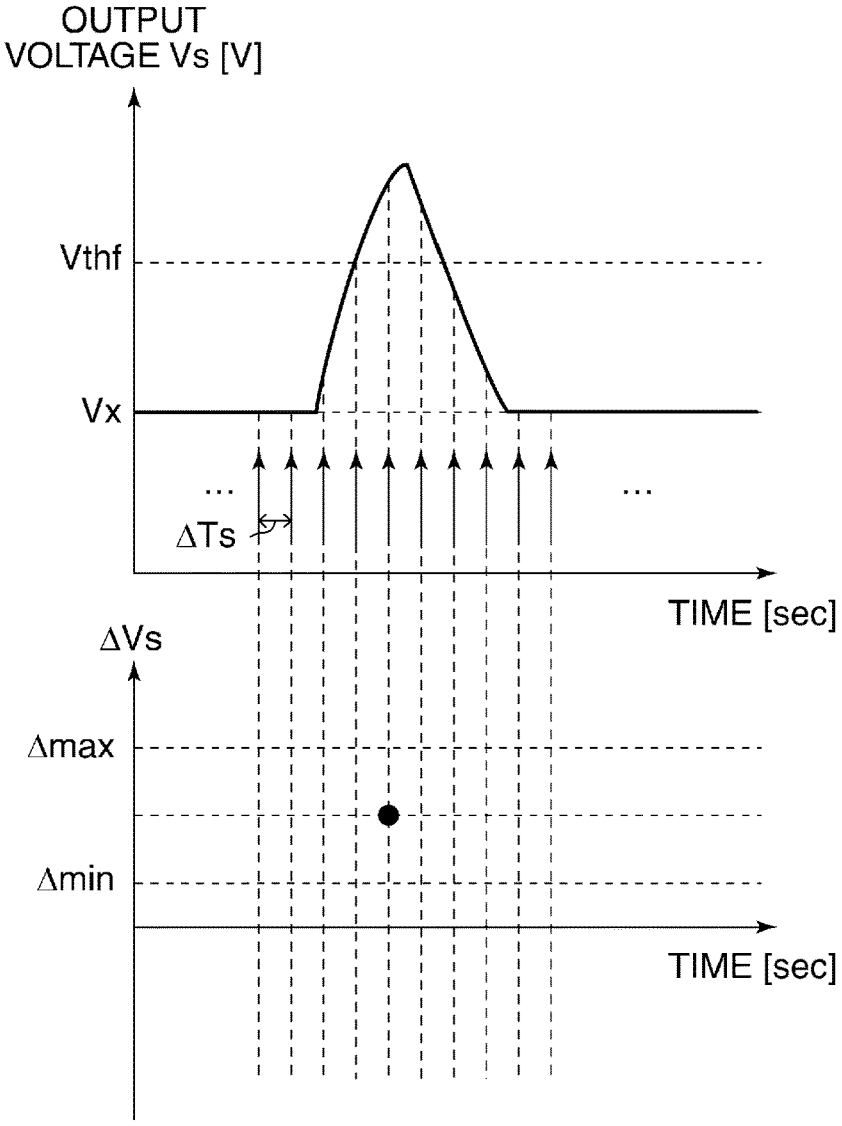
FIG. 11B is a graph showing an example of the time variation of the output voltage in a case where a bubble passes the light beam zone of the cell.

FIG. 11B is a graph showing an example of the time variation of the output voltage Vs in a case where a bubble mixed into the liquid developer passes the light beam zone of the cell 300. As also described in the first embodiment, when the bubble flows through the cell 300, the waveform of the output voltage Vs changes rapidly as shown in FIG. 11B. In the second embodiment of the present invention, the CPU 16 determines the presence or absence of a bubble on the basis of a change degree (change rate ΔVs) of the output voltage Vs after the output voltage Vs exceeds the first threshold Vthf.

The waveform shown in the graph in FIG. 11B is obtained by sampling the output voltage Vs at predetermined time intervals. The sampling interval ΔTs is indicated as a gap between upward arrows. The FPGA 31 is used for a sampling process in order to compute the change rate ΔVs at a high accuracy. When the output voltage Vs that is a sampling value exceeds the first threshold Vthf, the CPU 16 determines that a bubble may occur and computes the change rate ΔVs until the next sampling value is obtained according to the following formula.

$$\Delta Vs=(Vs-Vthf)/\Delta Ts$$

The change rate ΔVs is indicated by a black dot in the lower graph in FIG. 11B. Then, the CPU 16 determines that there is a bubble in a case where the change rate ΔVs falls within a predetermined range (Δmin through Δmax).

In the description, the lower limit Δmin (first degree) is set up in order to distinguish an effect of a bubble from actual concentration change that varies relatively gently. The upper limit Δmax (second degree) is set up in order to distinguish an effect of a bubble from an effect of rapid voltage fluctuation like an electrostatic impulse (electrostatic noise). Thus, an erroneous determination about the presence or absence of a bubble is avoided by cutting and dividing factors (electrostatic noise and gentle concentration change) other than a bubble. It should be noted that the lower limit Δmin and the upper limit Δmax are decided beforehand experimentally, and are stored in the ROM.

Figure 12:
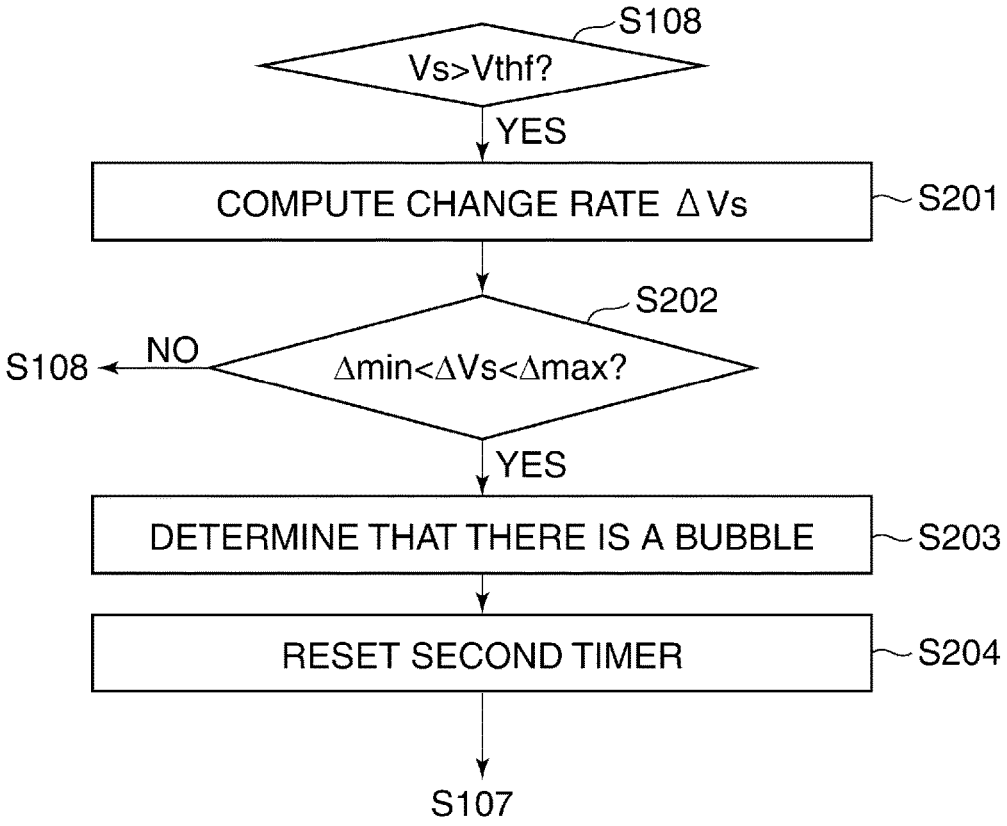
FIG. 12 is a part of a flowchart showing a process of a liquid circulation initial operation in the concentration measurement device according to the second embodiment.

FIG. 12 is a part of a flowchart showing a process of a liquid circulation initial operation. Since the processes in the steps S101 through S107, S109, and S110 are identical to that in FIG. 10, their illustrations and descriptions are omitted. The conditions of execution and starting of this flowchart are identical to the first embodiment described with reference to FIG. 10. The process after determination of YES in the step S108 will be described.

When the determination result in the step S108 is YES, the CPU 16 computes the change rate ΔVs in step S201 on the basis of the output voltage Vs, first threshold Vthf, and sampling interval ΔTs using the FPGA 31, as mentioned above. Next, the CPU 16 determines whether the change rate ΔVs is more than the lower limit Δmin and is less than the upper limit Δmax (Δmin<ΔVs<Δmax, step S202). Then, when the condition Δmin<ΔVs<Δmax is not satisfied, the CPU 16 returns the process to the step S108 (FIG. 10). This is because it is determined that the output voltage Vs rises due to noise or actual toner concentration change and that no bubble occurs as mentioned above.

On the other hand, when the condition Δmin<ΔVs<Δmax is satisfied, the CPU 16 performs the process similar to the steps S115 and S116 in FIG. 10 in steps S203 and S204. That is, the CPU 16 determines that there is a bubble, resets the second timer, and returns the process to the step S107 (FIG. 10). Thereby, the count value Tts2 is newly counted and the presence or absence of a bubble is determined again.

According to the second embodiment, the same result as the first embodiment is obtained about the determination of presence or absence of a bubble with a simple configuration.

It should be noted that the first embodiment and the second embodiment may be combined so as to employ both the determination method on the basis of the elapsed time Tsf and the determination method on the basis of the change rate ΔVs. In that case, it may be finally determined that there is no bubble in a case where it is determined that there is no bubble with both the determination methods. Alternatively, one of the determination methods may be selected by a user or an environmental condition at the time of starting the process of the liquid circulation initial operation.

Although the measurement unit 30 is arranged in the thin tube 18 through which the liquid developer is sent to the liquid tank 20 from the development device 1 in the first and second embodiments, the location of the measurement unit 30 is not limited to the thin tube 18. For example, the measurement unit 30 may be arranged in the path 17 through which the liquid developer is sent to the development device 1 from the liquid tank 20. The location of the measurement unit 300 is not limited to the liquid circulating paths between the liquid tank 20 and the development device 1. The measurement unit 300 may be arranged in a newly provided path for the concentration measurement through which the liquid developer circulates from the liquid tank 20 to the liquid tank 20.

The optical transmittance of black developer is extremely low and varies notably as compared with color developer. Accordingly, although the present invention is suitable for determining concentration of the liquid developer including black toner, it is applicable to concentration determination of liquid developer using color developer.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-039292, filed Mar. 2, 2017, which is hereby incorporated by reference herein in its entirety.

What is claimed is:

1. An image forming apparatus that forms an image on a sheet using a liquid developer including toner and carrier liquid, the image forming apparatus comprising:

a photosensitive member;

a charging unit configured to charge the photosensitive member;

an exposure unit configured to expose the charged photosensitive member to form an electrostatic latent image;

a development unit configured to store the liquid developer and to develop the electrostatic latent image using the liquid developer;

a supplying unit configured to supply toner and carrier liquid to the development unit;

a light emitting unit;

a light receiving unit configured to receive light that is emitted from the light emitting unit and passes through the liquid developer in the development unit, and to output an output value based on a light receiving amount;

a circulation unit configured to circulate the liquid developer stored in the development unit; and a controller configured to:

control the circulation unit to circulate the liquid developer stored in the development unit:

start emission of the light emitting unit; and determine whether a bubble is present in the liquid developer after a predetermined period elapses from an emission start of the light emitting unit according to a duration of a period of time from a first timing to a second timing, wherein the first timing corresponds to a timing at which the output value exceeds a first threshold, and the second timing corresponds to a timing at which the output value falls below a second threshold.

2. The image forming apparatus according to claim 1, wherein the controller determines that a bubble is present in the liquid developer in a case where the period is longer than a first period and shorter than a second period.

3. The image forming apparatus according to claim 1, wherein the controller determines that no bubble is present in the liquid developer in a case where a period during which the output value does not exceed the first threshold reaches a predetermined period.

4. The image forming apparatus according to claim 1, wherein the development unit starts developing the electrostatic latent image after a period during which the output value does not exceed the first threshold reaches a predetermined period.

5. The image forming apparatus according to claim 1, wherein the controller determines whether a bubble is present in the liquid developer while controlling the circulation unit to circulate the liquid developer.

6. The image forming apparatus according to claim 1, wherein the first threshold is equal to the second threshold.

7. The image forming apparatus according to claim 1, wherein the development unit has a thin tube, the light emitting unit irradiates the liquid developer flowing through the thin tube with light, and the light receiving unit receives the light that is transmitted through the thin tube.

* * * * *